US011241074B2

(12) United States Patent
Hermouet et al.

(10) Patent No.: US 11,241,074 B2
(45) Date of Patent: Feb. 8, 2022

(54) MASCARA BRUSH COMPONENT, MASCARA BRUSH AND MASCARA APPLICATION ASSEMBLY

(75) Inventors: Yannick Hermouet, Saran (FR); Noel Autie, Thiais (FR)

(73) Assignee: Parfums Christian Dior, Paris (FR)

( * ) Notice: Subject to any disclaimer, the term of this patent is extended or adjusted under 35 U.S.C. 154(b) by 0 days.

(21) Appl. No.: 12/995,265

(22) PCT Filed: May 29, 2009

(86) PCT No.: PCT/FR2009/051020
§ 371 (c)(1),
(2), (4) Date: Nov. 30, 2010

(87) PCT Pub. No.: WO2009/156665
PCT Pub. Date: Dec. 30, 2009

(65) Prior Publication Data

US 2011/0073127 A1 Mar. 31, 2011

(30) Foreign Application Priority Data

Jun. 3, 2008 (FR) ..... 0853677

(51) Int. Cl.
*A45D 40/26* (2006.01)
*A46B 9/02* (2006.01)

(52) U.S. Cl.
CPC ..... *A45D 40/265* (2013.01); *A46B 9/021* (2013.01); *A45D 40/262* (2013.01)

(58) Field of Classification Search
CPC ..... A45D 40/26; A45D 24/00; A45D 40/265; A46B 9/028; A46B 9/021; A46B 2200/1053; A46B 2200/106
USPC ..... 132/218, 313; 401/129
See application file for complete search history.

(56) References Cited

U.S. PATENT DOCUMENTS

| | | | | |
|---|---|---|---|---|
| 3,085,273 | A * | 4/1963 | Cowan | 15/167.1 |
| 4,081,876 | A * | 4/1978 | Pugh | 15/167.1 |
| 5,335,465 | A * | 8/1994 | Gueret | 132/218 |
| D443,985 | S * | 6/2001 | Beals et al. | D4/104 |
| 6,272,714 | B2 * | 8/2001 | Beals | 15/167.1 |
| 6,343,607 | B1 * | 2/2002 | Gueret | 132/218 |
| 6,539,950 | B1 * | 4/2003 | Gueret | 132/218 |

(Continued)

FOREIGN PATENT DOCUMENTS

| | | |
|---|---|---|
| EM | 000724208 | 5/2007 |
| EP | 0 663 161 | 7/1995 |

(Continued)

OTHER PUBLICATIONS

Abstract dated Jan. 28, 2004 for Application No. EP 1 384 417.

(Continued)

*Primary Examiner* — Rachel R Steitz
(74) *Attorney, Agent, or Firm* — Frost Brown Todd LLC

(57) ABSTRACT

The mascara brush component comprises: a body (12) that extends along a longitudinal direction (X) and that comprises an outer surface, a row of application members (13) that each extend between a first end (16) connected to the body (12) and a free second end (17) at a distance from the body. The application members of the row extend on average in an application plane (P), and the longitudinal direction (X) forms, with the application plane (P), a non-zero angle between 2° and 30°.

20 Claims, 4 Drawing Sheets

(56) References Cited

U.S. PATENT DOCUMENTS

Figure 1:
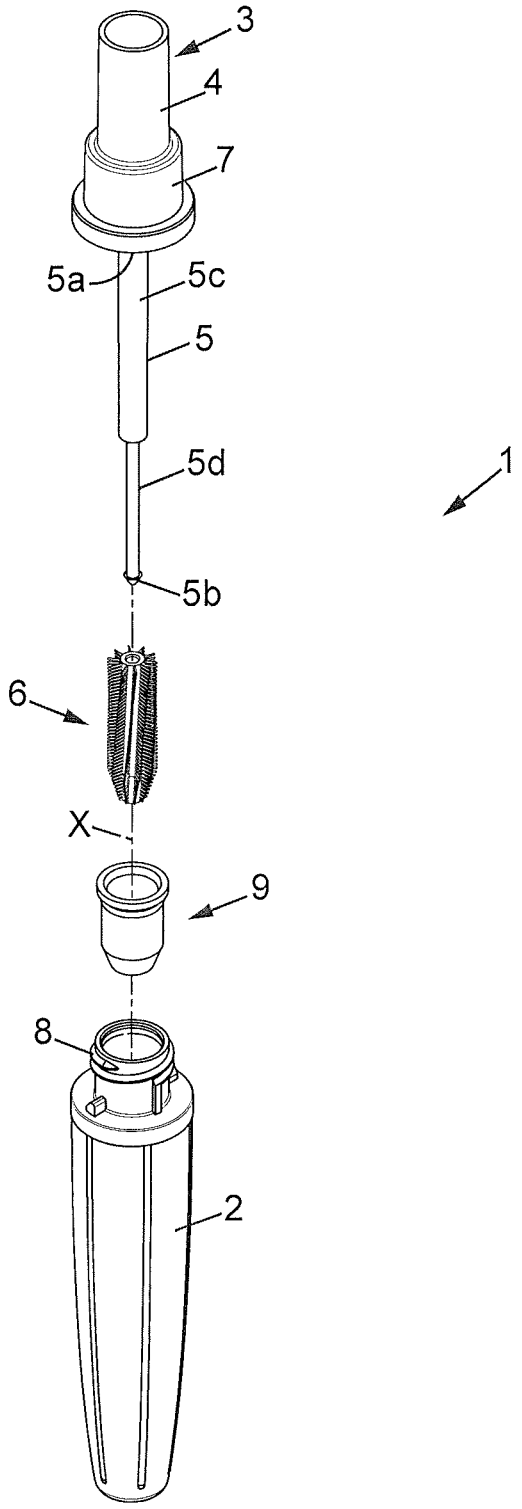

| | | | | |
|---|---|---|---|---|
| 6,581,610 | B1 | 6/2003 | Gueret | |
| 6,616,366 | B1 | 9/2003 | Weihrauch | |
| 7,325,550 | B2 | 2/2008 | Eckers et al. | |
| 9,402,455 | B2 * | 8/2016 | Osvaldo | A45D 40/265 |
| 2002/0020426 | A1 | 2/2002 | Gueret | |
| 2002/0023658 | A1 * | 2/2002 | Gueret | 132/218 |
| 2002/0142860 | A1 | 10/2002 | Klyve | |
| 2004/0168689 | A1 | 9/2004 | Kuriyama | |
| 2004/0221865 | A1 * | 11/2004 | Kim | 132/218 |
| 2004/0240926 | A1 | 12/2004 | Gueret | |
| 2005/0034740 | A1 | 2/2005 | Eckers et al. | |
| 2005/0217691 | A1 | 10/2005 | Petit | |
| 2006/0054179 | A1 | 3/2006 | Miki | |
| 2007/0033760 | A1 | 2/2007 | Dumler | |
| 2007/0062552 | A1 | 3/2007 | De Brouwer et al. | |
| 2008/0023020 | A1 * | 1/2008 | Gueret | A45D 40/265 132/218 |
| 2008/0245382 | A1 * | 10/2008 | Marciniak-Davoult et al. | 132/200 |
| 2009/0194128 | A1 * | 8/2009 | Vandromme | 132/218 |

FOREIGN PATENT DOCUMENTS

| | | |
|---|---|---|
| EP | 1 175 847 | 1/2002 |
| EP | 1 384 417 | 1/2004 |
| EP | 1 602 300 | 12/2005 |
| EP | 1 607 020 | 12/2005 |
| EP | 1 304 944 | 12/2006 |
| EP | 1 767 119 | 3/2007 |
| EP | 1 932 444 | 6/2008 |
| FR | 2 878 130 | 5/2006 |
| FR | 2 903 585 | 1/2008 |
| WO | WO 2007/007449 | 1/2007 |

OTHER PUBLICATIONS

Abstract dated Dec. 7, 2005 for Application No. EP 1 602 300.
Abstract dated Dec. 21, 2005 for Application No. EP 1 607 020.
Abstract dated Jan. 18, 2007 for Application No. WO 2007/007449.
French Search Report dated Feb. 20, 2009 for Application No. FR0853677.
French Written Opinion dated Jun. 3, 2008 for Application No. FR0853677.
International Search Report dated Feb. 15, 2010 for Application No. PCT/FR09/051020.
International Written Opinion dated Feb. 15, 2010 for Application No. PCT/FR09/051020.
Maybelline, Nouveau CIL Definition Mascara Longueur Cil A' Cil, www.gemey-maybelline.com (Sep. 28, 2007) or Prima Magazine (Sep. 2007).
Abstract for FR 2 903 585.
International Search Report dated Feb. 15, 2010 for Application No. PCT/FR2009/051020.

* cited by examiner

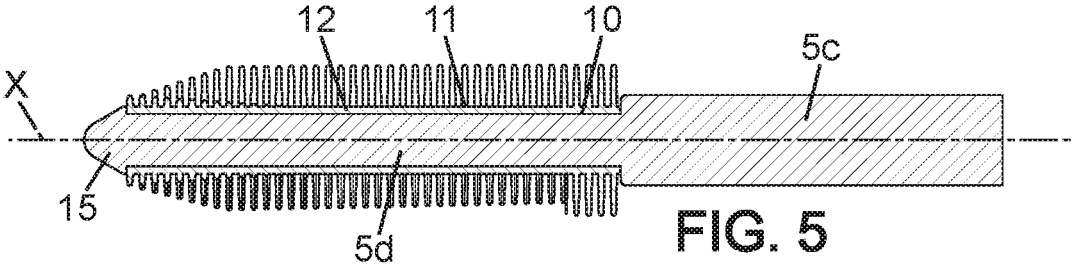
FIG. 5
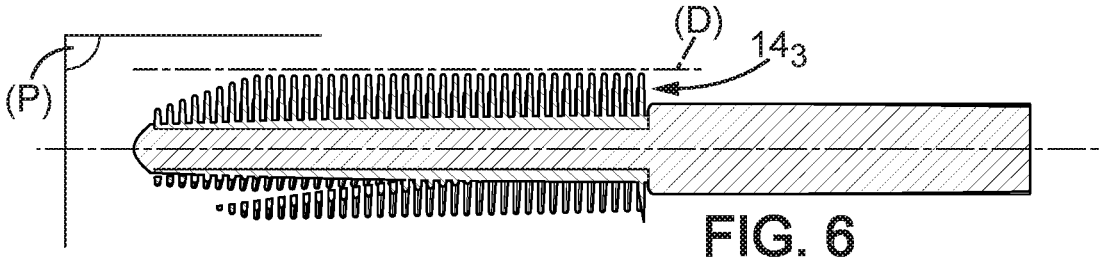
FIG. 6
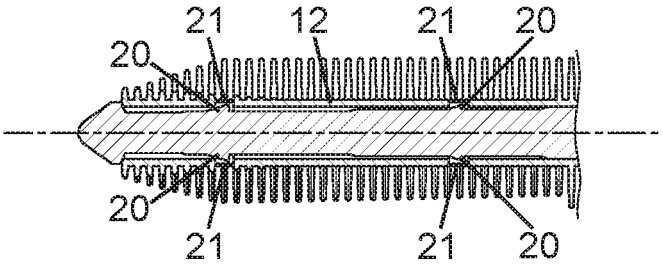
FIG. 7
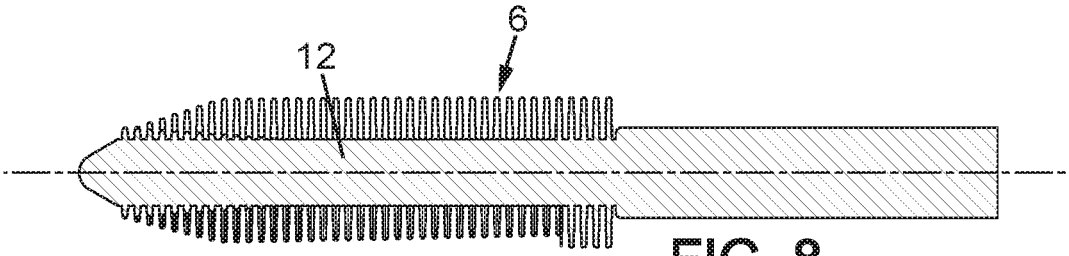
FIG. 8
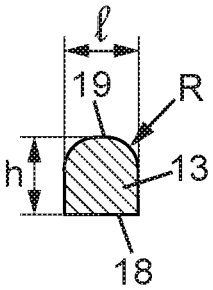
FIG. 9
FIG. 10
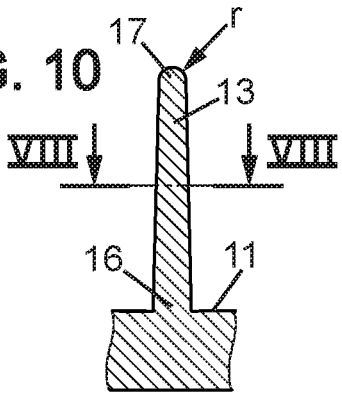

MASCARA BRUSH COMPONENT, MASCARA BRUSH AND MASCARA APPLICATION ASSEMBLY

The present invention relates to the components of a mascara brush, mascara brushes, and mascara application assemblies.

More particularly, the invention relates to a mascara brush component that comprises:

- a body that extends along a longitudinal direction, and that comprises an outer surface,
- at least one row of at least ten application members that each extend between a first end connected to the body and a free second end at a distance from the body.

Document FR 2 878 130 describes an example of such a mascara brush.

Although this mascara brush is fully satisfactory, the purpose is to further improve the effects of the application of mascara on the eyelashes.

To this end, according to the invention, a component for a mascara brush of the type in question is characterized:

in that the application members of said row define on average an application plane, and in that the longitudinal direction forms with the application plane a non-zero angle comprised between 2° and 30°, and preferably between 2° and 15°.

Surprisingly, a significant curving of the eyelashes and/or a wider opening of the eye has been observed.

In preferred embodiments of the invention it is also possible, optionally, to make use of one and/or another of the following arrangements:

- the first ends of the application members of said row are arranged on average along a first direction, the application members of said row extend on average along a second direction, and the first and second directions define the application plane;
- said row of application members extends parallel to the application plane between a proximal application member and a distal application member, the proximal application member extending substantially orthogonally to the outer surface, and the distal application member extending substantially tangentially to the outer surface;
- said row extends between a proximal end and a distal end and has:
  - a proximal sub-group adjacent to the proximal end and comprising at least five application members,
  - a distal sub-group adjacent to the distal end and comprising shorter application members than those of the proximal sub-group and having decreasing lengths towards the distal end;
- the component comprises a plurality of separate rows, each one comprising at least ten application members that each extend between a first end connected to the body and a free second end at a distance from the body, the application members of each row defining on average an application plane for the row in question, the longitudinal direction forming with each application plane a non-zero angle comprised between 2° and 30°, preferably between 2° and 15°;
- the body comprises a cylindrical sleeve that extends longitudinally along said longitudinal direction;
- the body and the application members are produced from a same elastomer material.

According to a further aspect, the invention relates to a mascara brush that comprises a grip member suitable for being held by a user, a rod (5) integral with the grip member, and a component as defined above, the component being fixed to the rod.

In a particular embodiment, it can be further provided that the rod is produced from a plastic material having a given hardness and the body of the component comprises a cylindrical sleeve that extends along said longitudinal direction and is tightly fitted onto the rod, the component being moulded in one piece from an elastomer material having a hardness that is less than the hardness of the material of the rod.

According to a further aspect, the invention relates to a mascara application assembly that comprises a bottle containing a mascara and a brush as defined above, suitable for dipping into the bottle so that the application members are at least partially coated with mascara.

Other characteristics and advantages of the invention will become apparent during the following description of two of its embodiments, given by way of non-limitative example, with reference to the attached drawings.

IN THE DRAWINGS

Figure 3:
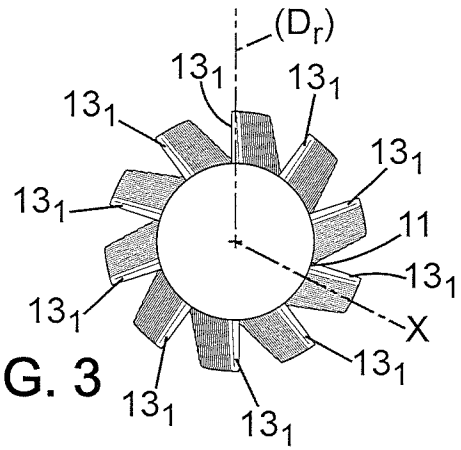
Figure 4:
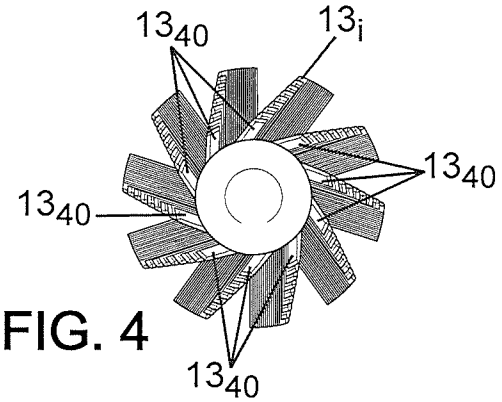
Figure 2:
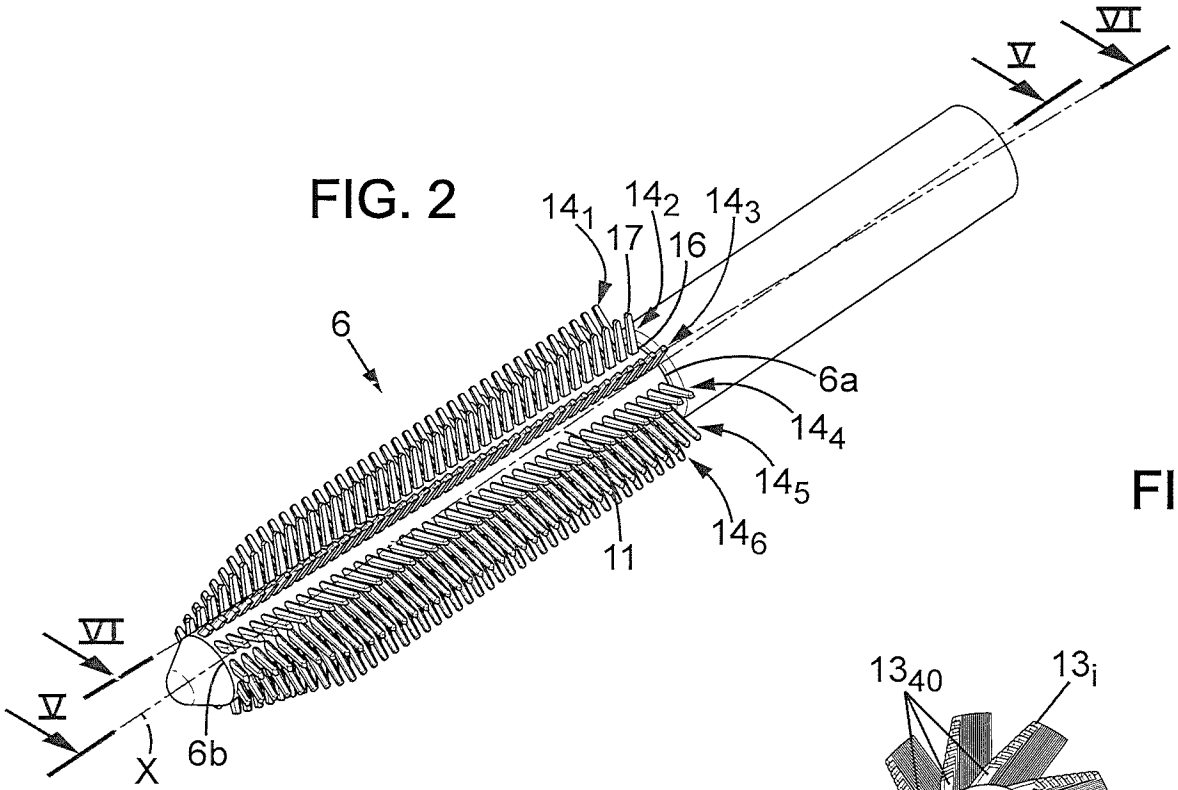

FIG. 1 is an exploded isometric view of a mascara application assembly according to the first embodiment, FIG. 2 is an isometric view of a part of the mascara brush of the assembly in FIG. 1, FIG. 3 is a rear view of FIG. 2, FIG. 4 is a front view of FIG. 2, FIG. 5 is a cross-sectional view along the line V-V in FIG. 2, FIG. 6 is a cross-sectional view along the line VI-VI in FIG. 2, FIG. 7 is a detail view of FIG. 5, FIG. 8 is a view corresponding to FIG. 5 for a second embodiment, FIG. 9 is a transverse cross-sectional view through an application member, and FIG. 10 is a longitudinal cross-sectional view through an application member.

Figure 11:
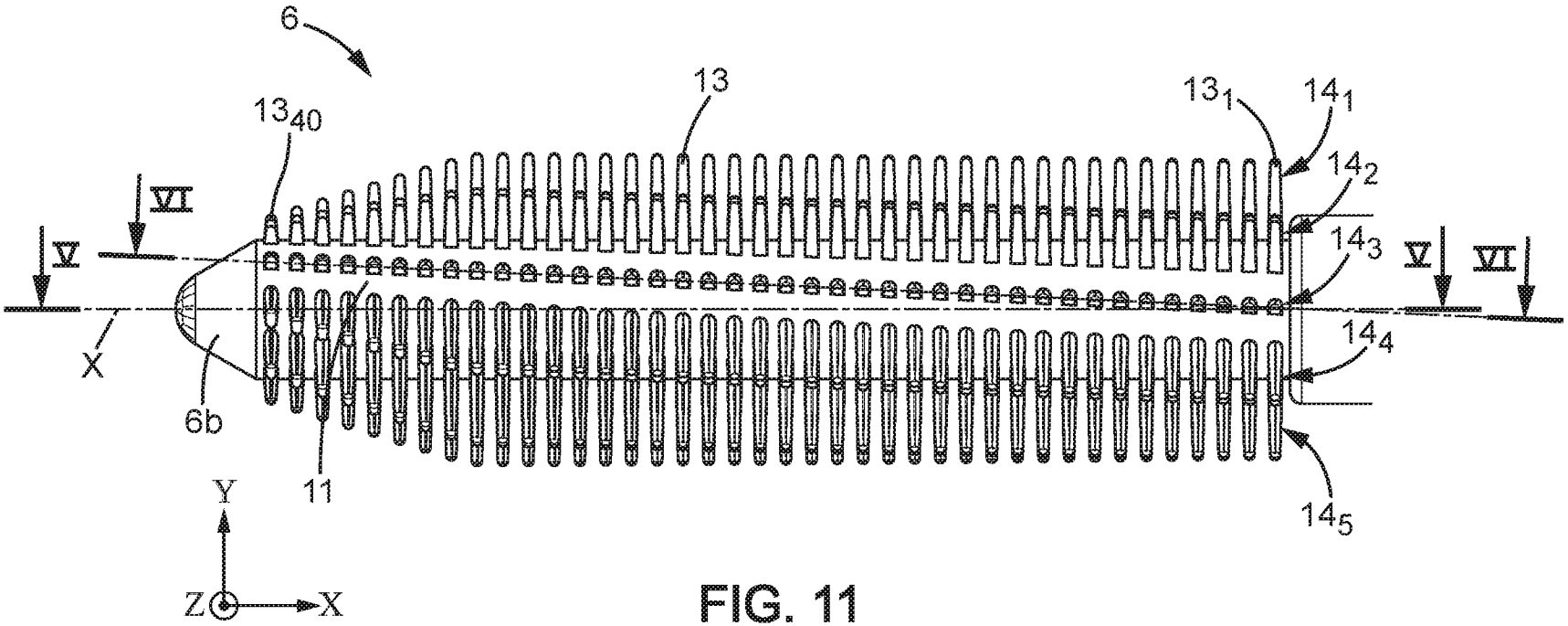

FIG. 11 is a top plan view of the mascara brush of FIG. 2.

The same references in different figures denote identical or similar components.

FIG. 1 shows an application assembly 1 such as a tube, for applying mascara or another cosmetic product. The assembly 1 comprises a bottle 2 capable of containing the product to be applied and a brush 3. The brush 3 includes a grip element 4 capable of being held by a male or female user wishing to apply cosmetic product, and a rod 5 that extends from a proximal end 5*a* to an opposite distal end 5*b* along a longitudinal axis X which, in the present example, extends in rectilinear fashion. The rod 5 bears an application component 6 that will be described in further detail hereinafter.

In the example shown purely for the purposes of illustration, the grip element 4 also forms a closure element suitable for closing the bottle 2. For example, a part of the brush 3 forming a stopper 7 includes, on an inner face, not shown in FIG. 1, a threaded bore that cooperates with a complementary thread 8 formed on the outer surface of the bottle 2. Thus, the bottle 2 can be easily alternatively opened or closed by a simple rotation movement of the stopper 7 about the axis X.

The rod 5 includes a proximal portion 5*c* close to the grip element 4, and a distal portion 5*d* having a smaller cross section and receiving the application component 6 such that, in the closed position of the assembly 1, it is dipped into the cosmetic product to be applied. The bottle 2 also includes a wiping member 9 of the conventional type, through which the application component 6 passes when the brush 3 is withdrawn from the bottle 2, in such a way that only an adequate quantity of cosmetic product is held by the application component 6 during its use by the user.

As shown in particular in FIG. 2, the application component 6 comprises a body 12 generally elongated along the longitudinal axis X between a proximal end 6*a* and a distal end 6*b*. In the example shown, the longitudinal axis X is a rectilinear axis. However, provision can be made for the component 6 to have a slightly curved longitudinal axis. In such case, the longitudinal axis can be regarded as a curved line linking the two ends of the component that are the most distant from one another and passing through the centres of sections that are transverse to the component encompassed between these two ends.

In the example shown purely for the purposes of illustration, the application component 6 has the general shape of a cylindrical sleeve, the axis of which is the longitudinal axis X, and having an annular transverse cross-section (see in particular FIG. 5). The sleeve comprises a cylindrical inner face 10, the axis of which is the longitudinal axis X, and complementary to the outer face of the distal portion 5*d* of the rod 5, for example having a circular cross-section. The sleeve comprises an outer face 11, for example cylindrical, the axis of which is the longitudinal axis X, and having a circular transverse cross-section. However, any other suitable type of geometry can be provided for the outer surface 11 of the component 6 within the context of the invention.

The component 6 includes a plurality of rows $\mathbf{14}_1$, $\mathbf{14}_2$, . . . , of application elements, these rows 14 being offset in relation to each other in a circumferential direction of the component 6. By way of example, the component 6 includes ten identical rows of application elements uniformly distributed in the circumferential direction.

By "row" is meant that the application members of a single row extend substantially one behind the other from the proximal end 6*a* to the distal end 6*b* of the component 6. They are for example arranged equidistantly, while being spaced apart by a gap having a size of the order of the size of the application member, for example approximately 0.3 millimetres.

Each row includes at least ten application members and, in the present example, forty application members $\mathbf{13}_1$, . . . , $\mathbf{13}_{40}$. However, this number of application members per row is purely for illustration purposes.

Each application member 13 is a member elongated along a main longitudinal direction, and extends from a first end 16 at which it is connected to the upper face 11 of the sleeve 12, to an opposite second end 17, called free.

In a given row 14, a group of application elements 13 are all provided in the same plane, called the "application plane". In the example presented, all the application members of a single row form such a group. However, in a variant, it is possible to envisage that only one sub-group of consecutive application members that comprises at least ten application members, forms a row defining an application plane, the row in question then forming only a part of one of the rows 14.

Of course, belonging to the application plane is defined with the tolerance relating at least to the flexibility of the material constituting these members, and to the tolerances of the manufacturing process. Taking account of these tolerances, it can be said that each row on average defines an application plane.

As a result, in the example presented, the free ends of the application members of the row extend in the application plane, as well as the first ends.

In the example presented, a first sub-group of a row called "proximal sub-group", that comprises at least five and, in the present example, the thirty-two proximal teeth $\mathbf{13}_1$ to $\mathbf{13}_i$ has its free ends along a straight line called straight line of application D. A second sub-group called "distal sub-group", having application members $\mathbf{13}_i$ to $\mathbf{13}_{40}$ of the same row, has free ends that are not aligned with the straight line D and are situated substantially between the straight line D and the longitudinal axis X.

With such a geometry, a row of application members uniquely defines the application plane P. It will be noted that the application elements $\mathbf{13}_1$ to $\mathbf{13}_i$ of the proximal sub-assembly all have slightly different lengths, due to the outer surface 11 that has a constant circular cross-section along the longitudinal axis X. Their length increases progressively from the member $\mathbf{13}_1$ to the member $\mathbf{13}_i$. Then, their length decreases, for example linearly, from the member $\mathbf{13}_i$ to the member $\mathbf{13}_{40}$, among the members of the distal sub-group.

As shown in FIGS. 3 and 4, the application members can be included in a circle. In particular, the free ends of the application members of the proximal sub-group are equidistant from the longitudinal axis X. The diameter can for example be 7.9 millimetres.

In a variant embodiment, it will be noted that all the free ends of the application members of a single row could be aligned along the straight line D, in which case the application plane P would be defined by the straight line D and an average general direction of radial extension $D_r$ of the application members of the row. The direction $D_r$ is for example the longitudinal direction of each of the application members, if they are all parallel to each other as in the example shown. However, if they are not all parallel to each other, it is possible to define an average plane of these application members that contains the direction $D_r$ as an average direction of extension of the application members between their ends.

Thus, the application plane P can be defined as the plane which is closest to the application members of the row in question.

In a variant, the application plane P can be defined on the basis of:

- a first direction that is the average direction along which the first ends of the application members are arranged,
- a second direction that is the average direction along which the application members of the row extend.

The first direction can be determined by taking the three-dimensional positions in space of the meeting points of the application members with the sleeve, and selecting the closest straight line to the set of points.

The second direction can be determined by taking the direction vector of each of the application members of the row, and calculating an average direction vector based thereon. The second direction is defined by a straight line having, as a direction vector, the average direction vector, and intersecting the first direction.

According to the embodiment shown, the application plane forms a non-zero angle of a few degrees with the longitudinal axis X. The angle between a straight line of the space and a plane of the space is defined by the angle formed between the straight line and the orthogonal projection of the straight line onto the plane in question. In the case of a curved longitudinal axis, the angle between the tangent to said curved longitudinal axis and the application plane is measured at any point of interest. If the curved longitudinal axis is included in a plane, the angle between said plane and the application plane is measured. An angle between two planes is determined by the angle formed between the normals to these two planes.

The embodiment presented is a purely illustrative example, and studies show that a satisfactory result is obtained when the angle between the application plane and the longitudinal direction X is comprised between 2° and 30°, and preferably between 2° and 15°.

It results from said construction that, depending on whether it is considered in rear view or in front view, the component 6 has a substantially different geometry. In the purely illustrative example, in rear view, the most proximal application members $\mathbf{13}_1$ extend substantially radially along a longitudinal axis intersecting with the longitudinal axis X and, as a result, substantially normally to the circular outer surface 11 of the sleeve 12 (FIG. 3).

The most distal application members $\mathbf{13}_{40}$ for their part extend substantially along an axis that does not intersect with the longitudinal axis X and, in the case of a circular outer surface 11 of the sleeve 12, substantially tangentially to said surface.

As can be seen in particular in FIG. 9, showing a cross-section of an application member taken in a plane perpendicular to its axis of extension, an application member 13 can have, in an illustrative embodiment, a plane surface 18 and an opposite convex surface 19, for example in the shape of an arc. Purely for the purposes of illustration, the application member 13 has a convex surface 19 having a radius of curvature R of the order of 0.17 millimetres, a length 1 of the order of 0.35 millimetres, and a height h of the order of 0.4 millimetres in the section plane. These measurements are for example taken at the point where the application member meets the outer surface 11 of the sleeve, and the application member can have a slightly conical shape becoming narrower towards its second end, at the level of which the width 1 is equal to approximately 0.25 millimetres.

Moreover, the application members 13, as can be seen in FIG. 10, can have a rounded free end 16, having for example a radius of curvature of the order of 0.125 millimetres.

The embodiment presented hitherto includes a component formed of a hollow cylindrical sleeve 12 formed from a suitable elastomer material, and application members 13 produced like rods, or teeth, from the same material, produced for example by moulding.

The sleeve 12 is force-fitted over an end 15 forming a collar, which holds it in position after fitting.

The sleeve 12 is fixed onto the rod 5 by any suitable means. For example, after the sleeve 12 has been put in position, a heading operation (not shown) of the collar is carried out, by which the plastic material of the collar is melted by application of heat, in order to form a flat part, so as to form a bead blocking the untimely exit of the sleeve 12.

As a variant or in addition, provision can be made (FIG. 7) for the rod 25 to have a plurality of flexible fins 20, each extending from an end connected to the rod 5 to a free end becoming more distant from the rod in the direction of the proximal end 5*a* of the rod. The fins 20 are for example arranged in a proximal stage and a distal stage, as shown, and, on each stage, uniformly distributed over the circumference of the rod (for example every 90°). The sleeve 12 has grooves 21 complementary to each fin 20.

When the sleeve 12 slides along the rod 5 to its fitted position, the fins 20 are bent and elastically return into a corresponding groove 21 in which they lock the sleeve against an opposite sliding movement of the sleeve (in particular when the brush subsequently passes through the wiping member of the bottle of cosmetic product).

The sleeve can be regarded as cylindrical when it has a slightly tapered shape, the distal end having an outside diameter that is smaller by less than 10%, even less than 5%, than the outside diameter of the proximal end. The diameters in question can for example be respectively of the order of 3.4 millimetres and 3.6 millimetres. The total length of the sleeve can be of the order of 26.1 millimetres and the length of the distal portion, approximately 15% to 25% of the total length, for example 5.2 millimetres.

According to a variant embodiment, as shown in FIG. 8, the component 6 comprises a solid cylindrical sleeve 12 made of an elastomer material holding the teeth 13, and fixed directly onto the proximal portion 5*c* of the rod 5. Thus, a number of variant embodiments can be envisaged, with respect to the manner of fixing the component 6 onto the brush 3.

Thus, although, in the embodiments presented, all the rows have an identical geometry, each defining an application plane forming an identical angle with the longitudinal axis X, provision can be made as a variant for all the rows not to be identical, and in particular for certain rows to define an application plane forming a zero angle with the longitudinal axis X.

Thus, if the brush 3 is held in the right hand in front of oneself, positioning the longitudinal axis X of the sleeve 12 substantially horizontally, in the embodiment presented, it will be noted that the straight line D, and consequently the application plane P, extends substantially sloping from bottom to top from the proximal end 6*a* to the distal end 6*b* of the component 6. Holding it in the left hand, the straight line D extends from top to bottom. However, symmetrical geometry can be envisaged.

Comparative tests have been carried out between a brush produced according to the embodiment presented herein, and a similar brush (comparative sample) in which the application plane is an axial application plane forming a zero angle with the longitudinal direction X.

Unexpectedly, these tests have made it possible to demonstrate that the brush according to the embodiment presented herein makes it possible to obtain a greater curving of the eyelashes than the comparative sample. The curving of the eyelashes was measured by considering the eye in profile, and by comparing the angle formed by the eyelash with the horizontal before application of the mascara and after application of the mascara.

These same tests have made it possible to demonstrate that the brush according to the embodiment presented makes it possible to obtain a wider opening of the eye than the comparative sample. The opening of the eye is measured by comparing the angle formed between the lower eyelashes and the upper eyelashes, considering the eye in profile before application of the mascara and after application of the mascara.

The invention claimed is:

1. Mascara brush component, wherein the mascara brush component comprises:

a body that comprises a cylindrical sleeve that extends along a longitudinal axis and that comprises an outer surface, at least one row of at least ten application members that each extend between a first end connected to the outer surface of the body and a free second end at a distance from the outer surface of the body along a second direction, wherein the first end of each application member of said row defines a radial direction extending between the longitudinal axis and the first end, wherein for each said row, an angle between the radial direction and the second direction of an application member of said row monotonically varies along the longitudinal axis in relation to an angle between the radial direction and the second direction of a first application member of said row, so that the application members of said row are comprised substantially in an application plane, wherein the longitudinal axis forms with the application plane a non-zero angle between 2° and 30°, and whereby the second direction of at least one application member of said row is a non-radial line, so that the second direction of the at least one application member and the longitudinal axis are skew lines.

2. Mascara brush component according to claim 1, wherein:

the first ends of the application members of said row are arranged on average along a first direction, the application members of said row extend on average along a second direction, and the first and second directions define the application plane.

3. Mascara brush component according to claim 1, wherein said row extends between a proximal end and a distal end and has:

a proximal sub-group adjacent to the proximal end and comprising at least five application members, a distal sub-group adjacent to the distal end and comprising shorter application members than those of the proximal sub-group and having decreasing lengths towards the distal end.

4. Mascara brush component according to claim 1, that comprises a plurality of separate rows, each comprising at least ten application members that each extend between a first end connected to the body and a free second end at a distance from the body, the application members of each row defining on average an application plane for said row, the longitudinal direction forming with each application plane a non-zero angle comprised between 2° and 30°.

5. Mascara brush component according to claim 1, wherein the body and the application members are produced from a same elastomer material.

6. Mascara brush that comprises a grip member adapted to be held by a user, a rod integral with the grip member, and a component according to claim 1, the component being attached to the rod.

7. Mascara brush according to claim 6, wherein the rod is produced from a plastic material having a given hardness and the body of the component comprises a cylindrical sleeve that extends along said longitudinal direction and is tightly fitted onto the rod, the component being moulded in one piece from an elastomer material having a hardness less than the hardness of the material of the rod.

8. Mascara application assembly that comprises a bottle containing a mascara and a brush according to claim 6, adapted to be dipped into the bottle so that the application members are at least partially coated with mascara.

9. Mascara brush component according to claim 1, wherein said row of application members extends parallel to the application plane between a proximal application member and a distal application member, the proximal application member extending substantially orthogonally to the outer surface, and the distal application member extending substantially tangentially to the outer surface.

10. Mascara brush component according to claim 1 wherein the angle between the application plane and the longitudinal direction is between 2° and 15°.

11. Mascara brush component, wherein the mascara brush component comprises:

a body that comprises a cylindrical sleeve that extends along a longitudinal direction, and that comprises an outer surface, at least one row of at least ten application members that each extend between a first end connected to the body and a free second end at a distance from the body, along a second direction, wherein the application members of said row are comprised in an application plane, wherein the free second ends of the application members of said row define a straight line comprised in said application plane, wherein the longitudinal direction forms with the application plane a non-zero angle between 2° and 30°, and wherein the second direction of at least one application member of said row is a non-radial line, so that the second direction of the at least one application member and the longitudinal direction are skew lines.

12. Mascara brush component according to claim 11, wherein said row extends between a proximal end and a distal end and has:

a proximal sub-group adjacent to the proximal end and comprising at least five application members, a distal sub-group adjacent to the distal end and comprising shorter application members than those of the proximal sub-group and having decreasing lengths towards the distal end.

13. Mascara brush component according to claim 11, that comprises a plurality of separate rows, each comprising at least ten application members that each extend between a first end connected to the body and a free second end at a distance from the body, the application members of each row defining an application plane for said row, the longitudinal direction forming with each application plane a non-zero angle comprised between 2° and 30°.

14. Mascara brush component according to claim 11, wherein the body and the application members are produced from a same elastomer material.

15. Mascara brush that comprises a grip member adapted to be held by a user, a rod integral with the grip member, and a component according to claim 11, the component being attached to the rod.

16. Mascara brush according to claim 15, wherein the rod is produced from a plastic material having a given hardness and the body of the component comprises a cylindrical sleeve that extends along said longitudinal direction and is tightly fitted onto the rod, the component being moulded in one piece from an elastomer material having a hardness less than the hardness of the material of the rod.

17. Mascara application assembly that comprises a bottle containing a mascara and a brush according to claim 15, adapted to be dipped into the bottle so that the application members are at least partially coated with mascara.

18. Mascara brush component according to claim 11, wherein said row of application members extends parallel to the application plane between a proximal application member and a distal application member, the proximal application member extending substantially orthogonally to the outer surface, and the distal application member extending substantially tangentially to the outer surface.

19. Mascara brush component according to claim 11, wherein the angle between the application plane and the longitudinal direction is between 2° and 15°.

20. Mascara brush component, wherein the mascara brush component comprises:

a body that comprises a cylindrical sleeve that extends along a longitudinal direction, and that comprises an outer surface, at least one row of at least ten application members that each extend between a first end connected to the body and a free second end at a distance from the body, along a second direction, wherein the first end of each application members defines a radial direction in the cylindrical sleeve with regard to the longitudinal direction, wherein for each of said row, an angle between the radial direction and the second direction of an application member varies along the longitudinal axis in relation to an angle between the radial direction and the second direction of a first application member of said row, so that the application members of said row are comprised in an application plane, wherein the longitudinal direction forms with the application plane a non-zero angle between 2° and 30°, and wherein the second direction of at least one application member of said row is a non-radial line, so that the second direction of the at least one application member and the longitudinal direction are skew lines.

* * * * *